US006173646B1

(12) United States Patent
Tanaka et al.

(10) Patent No.: US 6,173,646 B1
(45) Date of Patent: Jan. 16, 2001

(54) STENCIL PRINTING MACHINE AND STENCIL PRINTING DRUM

(75) Inventors: Yoshitaka Tanaka; Hideo Negishi, both of Ibaraki-ken (JP)

(73) Assignee: Riso Kagaku Corporation, Tolyo (JP)

( * ) Notice: Under 35 U.S.C. 154(b), the term of this patent shall be extended for 0 days.

(21) Appl. No.: 09/327,553

(22) Filed: Jun. 8, 1999

(30) Foreign Application Priority Data

Jun. 12, 1998 (JP) ..... 10-165198

(51) Int. Cl.[7] ..... B41F 15/38
(52) U.S. Cl. ..... 101/116
(58) Field of Search ..... 101/116, 120, 101/122, 127, 127.1, 128.21, 128.4

(56) References Cited

U.S. PATENT DOCUMENTS 3,783,779 * 1/1974 Greenwood et al. ..... 101/127
4,164,184 * 8/1979 Vertegaal ..... 101/127.1
4,379,185 * 4/1983 Smith et al. ..... 101/115
4,515,077 * 5/1985 Davidson et al. ..... 101/127
5,606,911 * 3/1997 Cane ..... 101/127.1
5,845,571 12/1998 Kurashige et al. ..... 101/120
5,979,312 * 11/1999 Williams ..... 101/127

FOREIGN PATENT DOCUMENTS

719396 * 12/1954 (GB) ..... 101/116
286744 * 12/1987 (JP) ..... 101/127.1

* cited by examiner

*Primary Examiner*—Stephen R. Funk
(74) *Attorney, Agent, or Firm*—Kanesaka & Takeuchi

(57) ABSTRACT

A stencil printing machine has a printing drum having a cylindrical circumferential wall adapted to receive a perforated stencil sheet wrapped on an outer circumferential surface thereof and driven to rotate around a central axis thereof the circumferential wall having an opening portion with many through holes formed therein, a non-opening portion formed around the opening portion, and at least one recessed portion formed in at least one part of the opening portion adjacent to the non-opening portion in an axial direction of the circumferential wall; an ink supplying roller situated in the printing drum for supplying ink to an inner circumferential surface of the cylindrical circumferential wall of the printing drum; and a press roller situated adjacent to the printing drum and being urged against the outer circumferential surface of the cylindrical circumferential wall of the printing drum.

15 Claims, 18 Drawing Sheets

STENCIL PRINTING MACHINE AND STENCIL PRINTING DRUM

BACKGROUND OF THE INVENTION

1. Field of the Invention

The present invention relates to a stencil printing machine capable of conducting clear printing, and a printing drum used in the printing machine.

2. Description of the Related Art

FIG. 16 and FIG. 17 are sectional views showing a printing section of a conventional stencil printing machine. FIG. 18 is a part of a circumferential wall of a printing drum; an essential portion of said printing section. A printing drum 100 has a circumferential wall 101. The printing drum 100 is rotatably supported by an axis 102 and driven to rotate around the axis by non-illustrated driving means. In the circumferential wall 101, there is formed an opening portion 104 (printing area) having many through holes 103 formed therein and a non-opening portion 105 (non-printing area) formed around said opening portion 104. Clamping means 106 is disposed on the non-opening portion 105 in an outer circumferential surface of the circumferential wall 101. A perforated stencil sheet 107 is clamped with the leading end thereof by the clamping means 106 and wrapped around the outer circumferential surface of the circumferential wall 101. Inside the printing drum 100, an ink supplying roller 108 is situated for supplying ink to an inner circumferential surface of the circumferential wall 101. Below the printing drum 100, a press roller 109 is situated to be vertically movably relative to the outer circumferential surface of the circumferential wall 101. At least the surface of the press roller 109 is composed of an elastic material such as rubber and so on. A printing sheet is supplied in synchronization with rotation of the printing drum 100. The printing sheet is pressed against a stencil sheet 107 on the circumferential surface of the printing drum 100 by the press roller 109 moving upward. Ink is supplied to the inner circumferential surface of the printing drum 100 and passes through the opening portion 104 and a perforated portion (perforations) of the stencil sheet 107 to transfer to the printing sheet, thereby forming an image thereon.

During printing in the aforementioned constitution, as shown in FIG. 16, the press roller 109 presses the stencil sheet 107 via a not-shown printing sheet. At the same time, on the opposite side of the press roller 109 relative to the printing drum 100, the ink supplying roller 108 contacts the inner circumferential surface of the printing drum 100. In this way, during printing wherein the printing drum 100, the press roller 109 and the ink supplying roller 108 are superimposed on one another, pressure required for printing is conventionally applied only to a center portion of the printing drum 100 in the axial direction of the drum. Therefore, printing pressures exerted on both end-portions of the printing drum may be not enough and images formed there may be indistinct.

This seems to be due to insufficient ink transferring onto the printing sheet at both end-portions of the printing drum in the axial direction. This is caused by the fact that rigidity of the circumferential wall 101 of the printing drum 100 varies widely from the central opening portion 104 to the non-opening portions on both sides in the axial direction of the printing drum 100, and that pressing force against both end-portions of the printing drum by the press roller 109 is reduced since the printing drum 100 is deformed while being pressed by the press roller 109.

If the pressing force exerted on the printing drum 100 by the press roller 109 is increased to improve such problems, enough printing pressure is assured on both the end portions of the opening portion 104 in the axial direction of the printing drum 100, thereby avoiding indistinct images to be formed there. However, printing pressure on the center of the opening portion 104 consequently increases, and ink transferring onto the center of printing sheet excessively increases. This brings another problems such as seeping-through, enlargement of printed images and so on.

SUMMARY OF THE INVENTION

The present invention is made in view of the problems aforementioned. An object of the present invention is to provide a stencil printing machine capable of uniformly exerting printing pressure on the entire of the opening area of the printing drum, thereby conducting normal printing on all of an effective printing area corresponding to the opening area.

A stencil printing machine as defined in a first aspect of the present invention comprises a printing drum including a cylindrical circumferential wall adapted to receive a perforated stencil sheet wrapped on an outer circumferential surface of itself and driven to rotate around a central axis of itself, the circumferential wall having an opening portion with many through holes formed therein, a non-opening portion formed around the opening portion, and at least one recessed portion formed in at least a part of the opening portion adjacent to the non-opening portion in an axial direction of the circumferential wall; an ink supplying roller situated in the printing drum for supplying ink to an inner circumferential surface of the cylindrical circumferential wall of the printing drum; and a press roller situated adjacent to the printing drum and being urged against the outer circumferential surface of the cylindrical circumferential wall of the printing drum.

In a stencil printing machine as defined in a second aspect of the present invention, the recessed portion communicates with the through hole in the stencil printing machine as defined in the first aspect.

In a stencil printing machine as defined in a third aspect of the present invention, the recessed portion is formed continuously to surround the through holes in the stencil printing machine as defined in the second aspect.

In a stencil printing machine as defined in a fourth aspect of the present invention, the recessed portion interconnects the through holes adjacent to each other in the stencil printing machine as defined in the second aspect.

In a stencil printing machine as defined in a fifth aspect of the present invention, the recessed portion includes a plurality of recesses formed separately from the through holes in the stencil printing machine as defined in the first aspect.

In a stencil printing machine as defined in a sixth aspect of the present invention, each of the recesses is formed between the through holes adjacent to each other in the circumferential wall in the stencil printing machine as defined in the fifth aspect.

In a stencil printing machine as defined in a seventh aspect of the present invention, the recessed portion includes a plurality of recesses, each being formed between the through holes adjacent to each other to extend in a circumferential direction of the printing drum in the stencil printing machine as defined in the second aspect.

In a stencil printing machine as defined in an eighth aspect of the present invention, each of the recesses is formed between the through holes adjacent to each other to extend in a circumferential direction of the printing drum in the stencil printing machine as defined in the fifth aspect.

In a stencil printing machine as defined in a ninth aspect of the present invention, the recessed portion is formed on the outer circumferential surface of the circumferential wall in the stencil printing machine as defined in the first aspect.

A stencil printing drum as defined in a tenth aspect of the present invention comprises a cylindrical circumferential wall adapted to receive a perforated stencil sheet wrapped on an outer circumferential surface of itself and driven to rotate around a central axis of itself, the circumferential wall having an opening portion with many through holes formed therein, a non-opening portion formed around the opening portion, and at least one recessed portion formed in the opening portion adjacent to the non-opening portion in an axial direction of the circumferential wall, wherein rigidity of the opening portion including the recessed portion is between rigidity of the non-opening portion and rigidity of the opening portion only including the through hole.

DETAILED DESCRIPTION OF PREFERRED EMBODIMENTS

Figure 1:
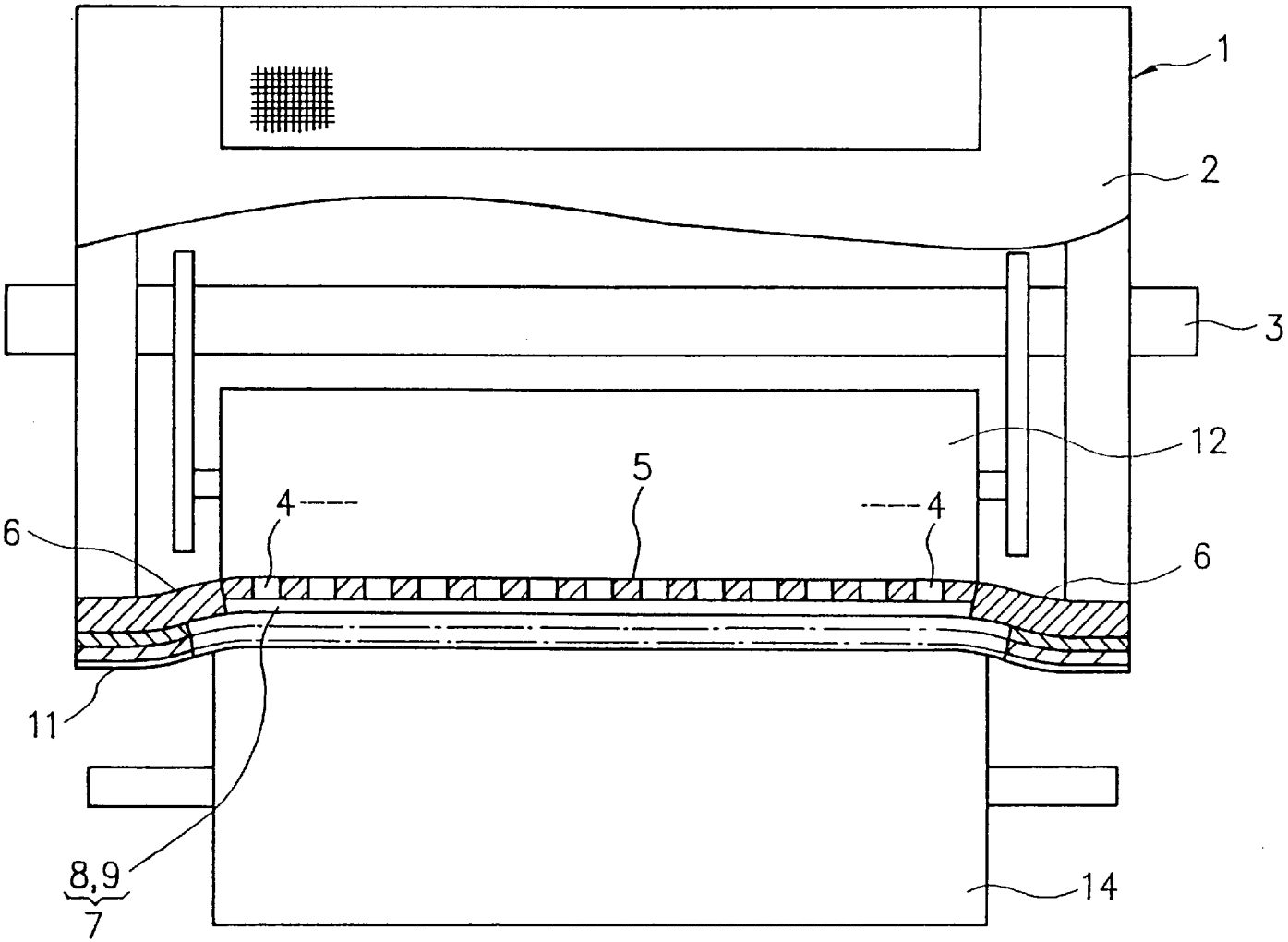
FIG. 1 is a sectional view of a first embodiment of the present invention.

Embodiments of the present invention will be explained referring to FIGS. 1 to 15.

A first embodiment will be explained referring to FIGS. 1 to 3.

A printing drum 1 has a cylindrical circumferential wall 2. The printing drum 1 is supported on a shaft 3 to be driven to rotate by driving means (not shown). As illustrated in FIG. 3, there are formed an opening portion 5 (printing area) and a non-opening portion 6 (non-printing area) in the circumferential wall 2. The opening portion 5 has many through holes 4 formed therein, and the non-opening portion is formed around the opening portion 5.

Figure 2:
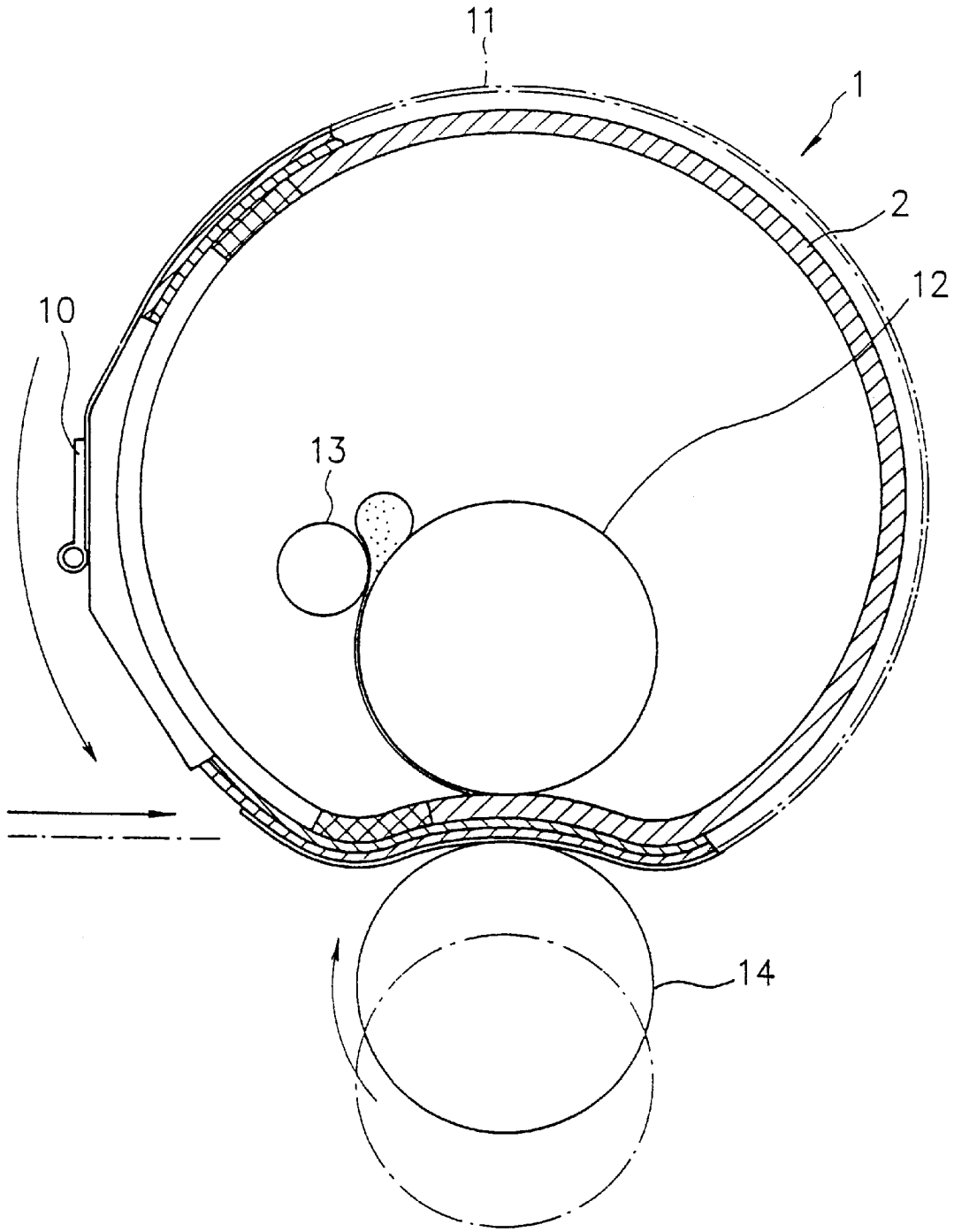
FIG. 2 is a sectional view taken along a plane perpendicular to FIG. 1.
Figure 3:
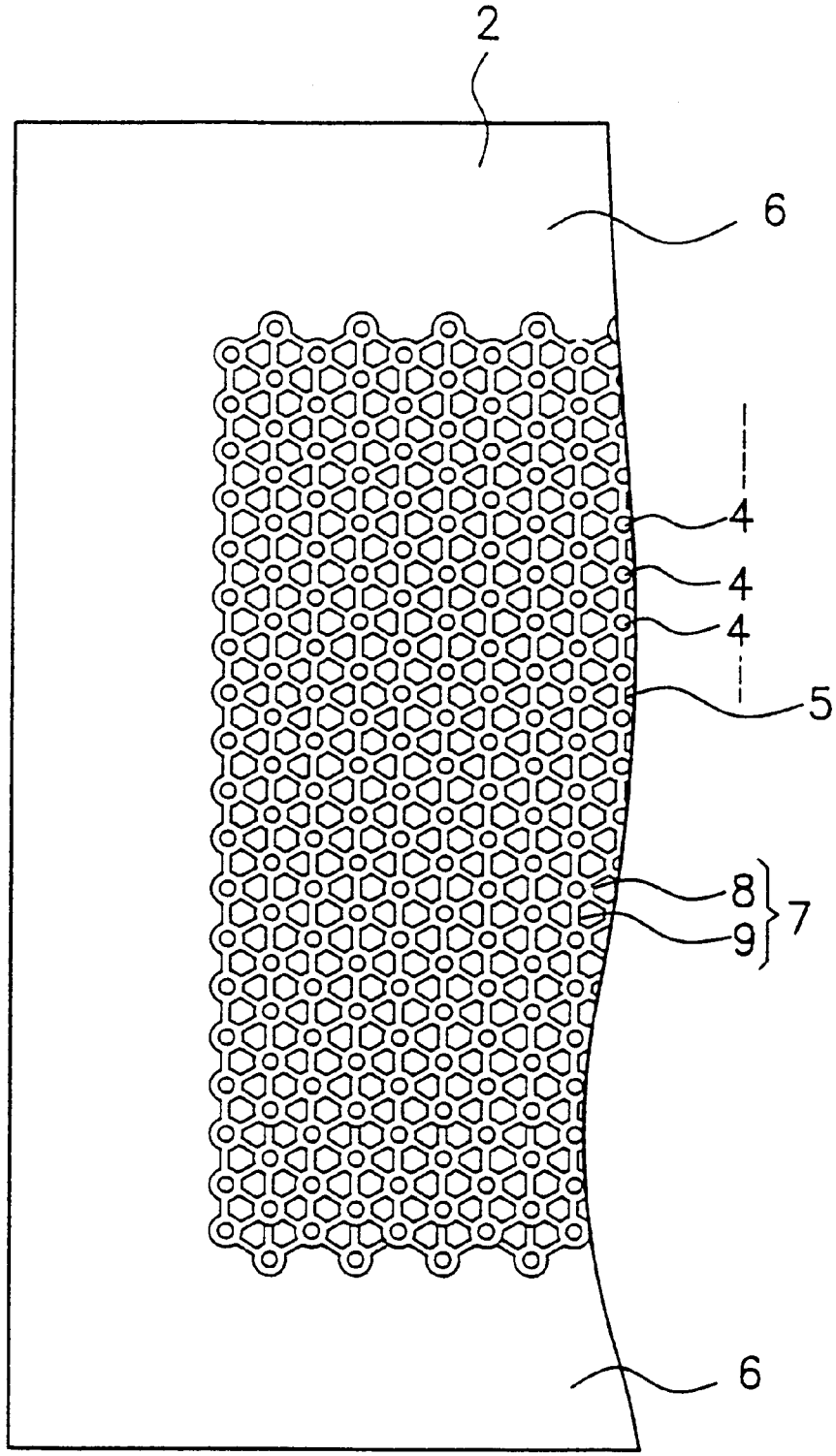
FIG. 3 is a partial plan view of a circumferential wall of the first embodiment.

As illustrated in FIG. 1 and FIG. 3, the through holes 4 are each circular, and formed to be arranged at a predetermined distance therebetween. A recessed portion 7 is formed in the opening portion 5 on an outer circumferential surface side of the circumferential wall 2. The recessed portion 7 of the present embodiment means a dent or a groove not passing through the circumferential wall 2. Concerning a shape of the recessed portion, arrangement of the recessed portion around the through hole 4, and on which surface (inner or outer) of the circumferential wall 2 where the recessed portion is formed, these are not particularly restricted. A condition of forming the recessed portion 7 in the present embodiment is that it should be formed at least in a part of the opening portion 5 adjacent to the non-opening portion 6 in the axial direction of the printing drum 1. Hence, the recessed portion 7 may be formed in the entire opening portion 5.

On this condition, rigidity of the opening portion 5 adjacent to the non-opening portion 6 in the present embodiment is smaller than that of the conventional opening portion 104 consisting of the through holes 103 and having no recessed portion. That is, the opening portion 5 with the recessed portion in the present embodiment is susceptible to bending by external force in comparison with the conventional opening portion 104.

In the present embodiment, the recessed portion comprises circular recesses 8 formed to surround the through holes 4 and groove type recesses 9 formed radially to interconnect the circular recesses 8, 8 adjacent to each other. Namely, the circular recess 8 is formed continuously to surround the through hole 4 to communicate with the through hole 4. And, the groove type recess 9 interconnects the through holes 4, 4 adjacent to each other through the circular recesses 8, 8. In this way, in the present embodiment, the recessed portion 7 is formed in the entire opening portion 5.

Clamp means 10 is attached to the non-opening portion 6 on the outer circumferential surface of the circumferential wall 2. A perforated stencil sheet 11 is fixed with its leading end by the clamp means 10, and then wrapped around the outer circumferential surface of the circumferential wall 2. In the printing drum 1, an ink supplying roller 12 is situated for supplying ink to the inner surface of the circumferential wall 2. A doctor roller 13 is situated near the ink supplying roller 12. The doctor roller 13 is disposed at a predetermined distance away from the ink supplying roller 12 for regulating ink supply provided through an outer circumferential surface of the ink supplying roller 12 to the inner circumferential surface of the circumferential wall 2. And, one layer or plural layers of screen material may be wrapped around the outer circumferential surface of the circumferential wall 2. The screen material is of fine mesh structure for uniformly providing ink to the stencil sheet.

A press roller 14 is disposed below the printing drum 1 for selectively pressing the outer circumferential surface of the circumferential wall 2. The press roller 14 is vertically movable while being synchronized with rotational movement of the printing drum 1. At least a surface of the press roller 14 is made of elastic material such as rubber.

A printing sheet is supplied in synchronization with rotation of the printing drum 1 and pressed against the stencil sheet 11 on the circumferential surface of the printing drum 1 by the ascended press roller 14. Ink provided on the inner circumferential surface of the printing drum 1 is allowed to pass through the opening portion 5 and perforated area of the stencil sheet 11, and then transferred to the printing sheet, thereby forming an image on the printing sheet.

According to the present embodiment, rigidity of both borders of opening portion 5 adjacent to non-opening portion 6 in the axial direction of the printing drum 1 is extremely low in comparison with rigidity of the non-opening portion 6. Consequently, the both borders of the opening portion 5 can be easily deformed. Hence, printing pressure is uniformly exerted on the entire of the opening portion 5. Therefore, quantity of ink transferred to a printing sheet is uniformed and a printed image without faintness can be obtained.

During stencil sheet discharging, ink accumulated between the stencil sheet 11 and the printing drum 1 is removed from the printing drum 1 by separating the used stencil sheet 11 from the drum 1 since the ink adheres to the stencil sheet 11. After that, next new stencil sheet 11 is wrapped around the drum to start printing; however, printing results are not normal in initial trials because of ink-shortage, since it takes time for ink to be fully accumulated between the stencil sheet 11 and the printing drum 1. In this regard, according to the present invention, ink pressed against the inner circumferential surface of the printing drum 1 is held in the recessed portion 7 since the recessed portion 7 is formed in the outer circumferential surface of the printing drum 1. Thus, when the stencil sheet 11 is removed, a certain amount of ink is left on the outer circumferential surface of the printing drum 1. Therefore, in the case where a new stencil sheet 11 is wrapped around the printing drum 1 to start printing, normal printing can be conducted from a first print.

Further, in the present embodiment, ink supplied to the outer surface from the inner surface of the printing drum 1 uniformly covers the printing area (the opening portion 5) while traveling through the recessed portion 7 since the recessed portions 7 are interconnected with each other. Thus, quality of printed matter obtained is further stabilized in uniform density.

Figure 4:
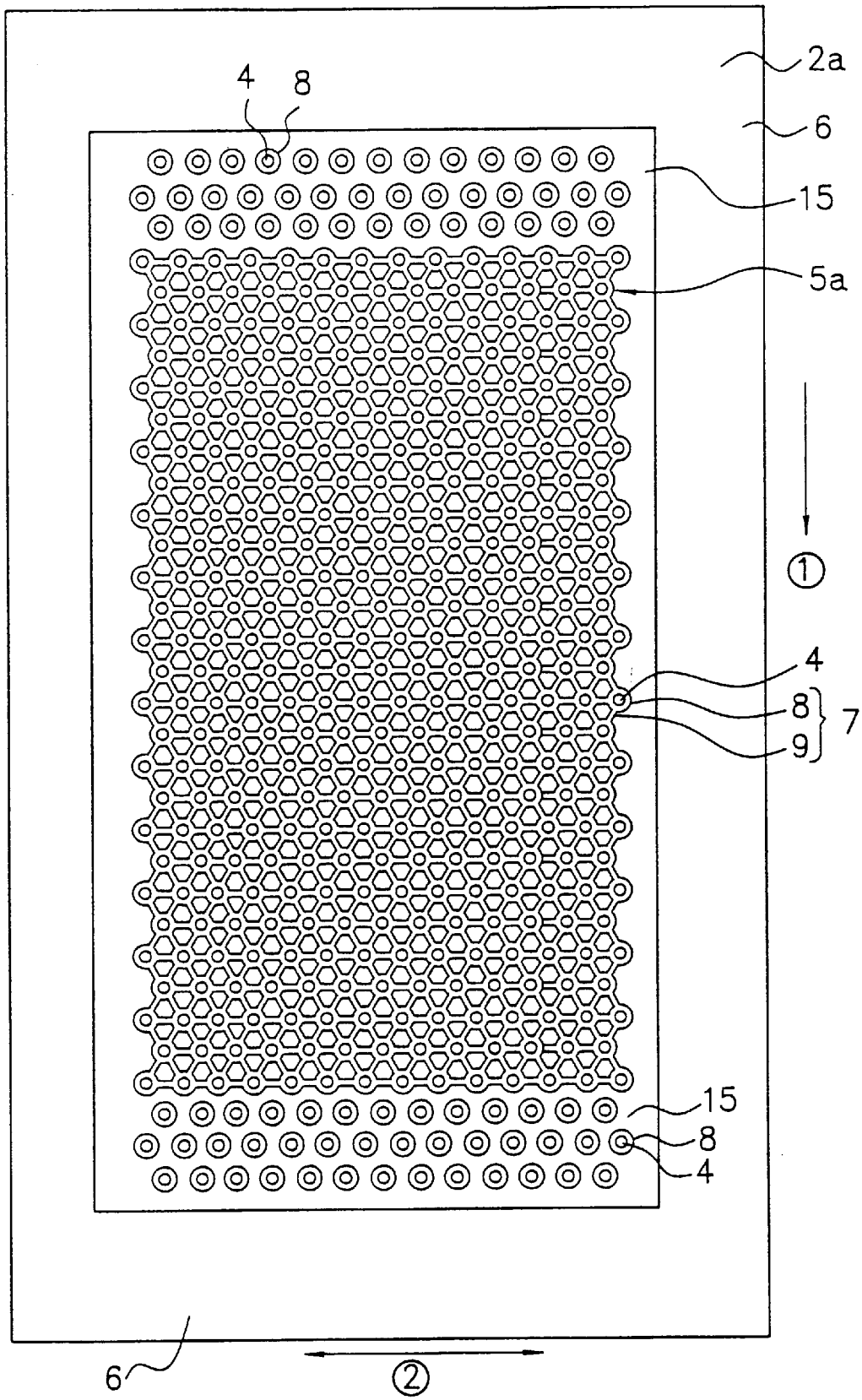
FIG. 4 is a plan view of a circumferential wall of a second embodiment.

A second embodiment will be explained referring to FIG. 4. As a stencil printing machine, basic constitution of this embodiment is approximately identical to that of the first embodiment. A pattern of a recessed portion in an opening portion 5*a* of the printing drum is different from the embodiment explained before. In the present embodiment, a pattern of an upper end (a head) and a lower end (a tail) in a rotational direction (1) of the printing drum, which direction is a circumferential direction or printing direction on printing sheet, is arranged to be different from that of another portion. Each recessed portion formed in this head and tail area 15 includes circular recesses respectively communicating through holes 4. In this head and tail area 15, the circular recesses 8 are independent from each other. They are not connected with each other.

According to the present embodiment, areas of a circumferential wall 2*a* are, in order of decreasing rigidity, the non-opening portion 6, the head and tail area 15, and the center of the opening portion. Rigidity of the circumferential wall 2*a* measured along the circumferential direction (1) increases or decreases stepwise via the head and tail area 15 having a medium value of rigidity. Thus, the circumferential wall is not likely to have cracked by pressing of the press roller 14 in comparison with the case where the rigidity sharply changes at a border portion.

Rigidity acting along the axial direction (2) of the printing drum 1 is identical to that of the first embodiment. Therefore, a printed image without faintness can be obtained similar to the first embodiment.

Figure 5:
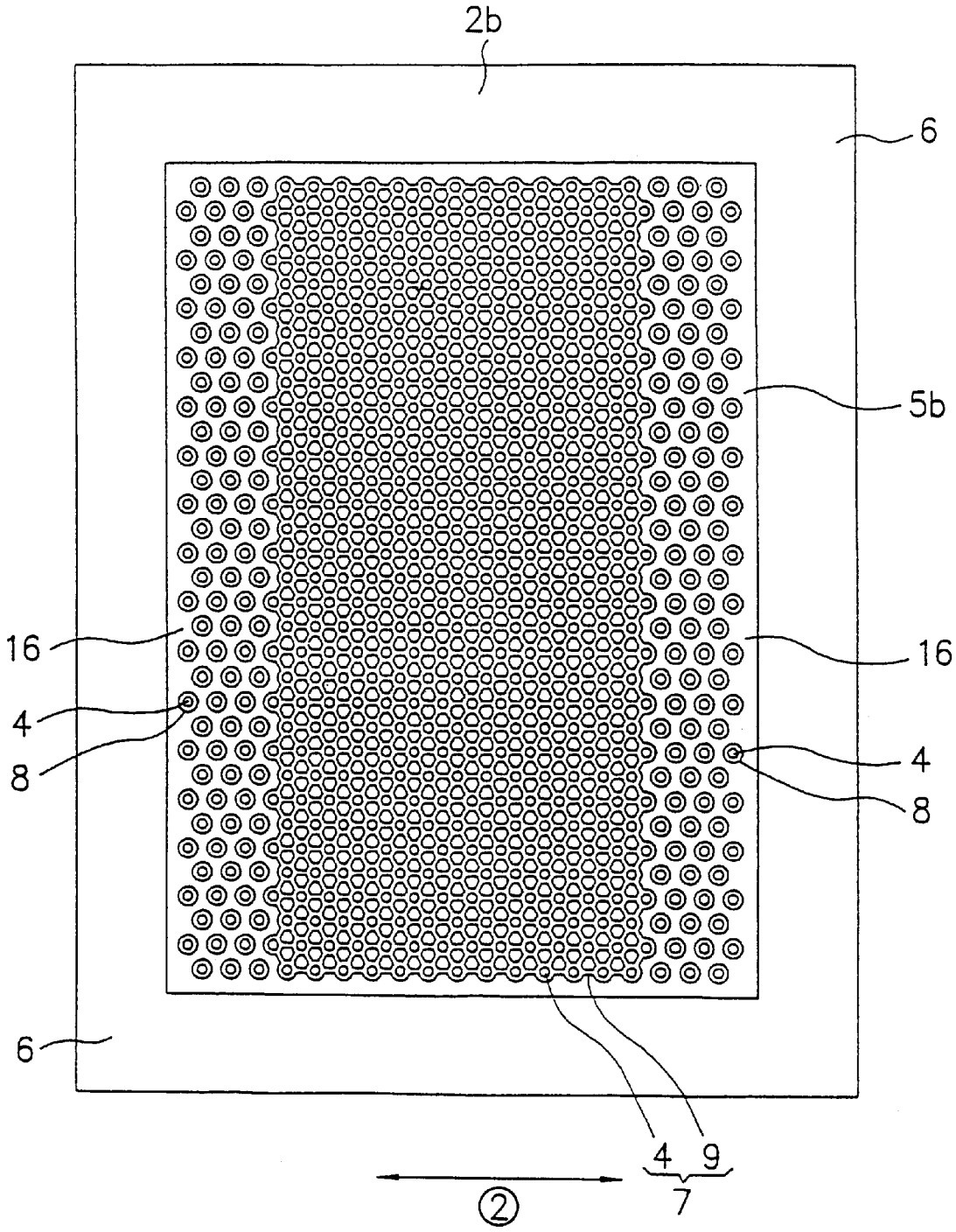
FIG. 5 is a plan view of a circumferential wall of a third embodiment.

A third embodiment will be explained referring to FIG. 5. As a stencil printing machine, basic constitution of this embodiment is approximately identical to that of the first embodiment. A pattern of a recessed portion in an opening portion 5*b* of the printing drum is different from the embodiment explained before. In the present embodiment, a medium area 16 is formed in both edge portions of an opening portion 5*b* (a printing area) adjacent to the non-opening portion 6 in the axial direction (2). Each recessed portion formed in this medium area 16 includes circular recesses respectively communicating through holes 4. In this medium area 16, the circular recesses 8 are independent from each other. They are not connected with each other.

According to the present embodiment, areas of a circumferential wall 2*b* are, in order of decreasing rigidity, the non-opening portion 6, the medium area 16, and the center of the opening portion 5*b*. Thus, both the edge portions of the opening portion 5*b* (the medium area 16) can deform without excessive force, and printing pressure can be uniformly applied to the entire of the opening portion 5*b*. Therefore, quantity of ink transferred to a printing sheet is uniformed and a printed image without faintness can be obtained. Further, repetitive deformation is not likely to destroy both the edge portions of the opening portion 5*b*.

Figure 6:
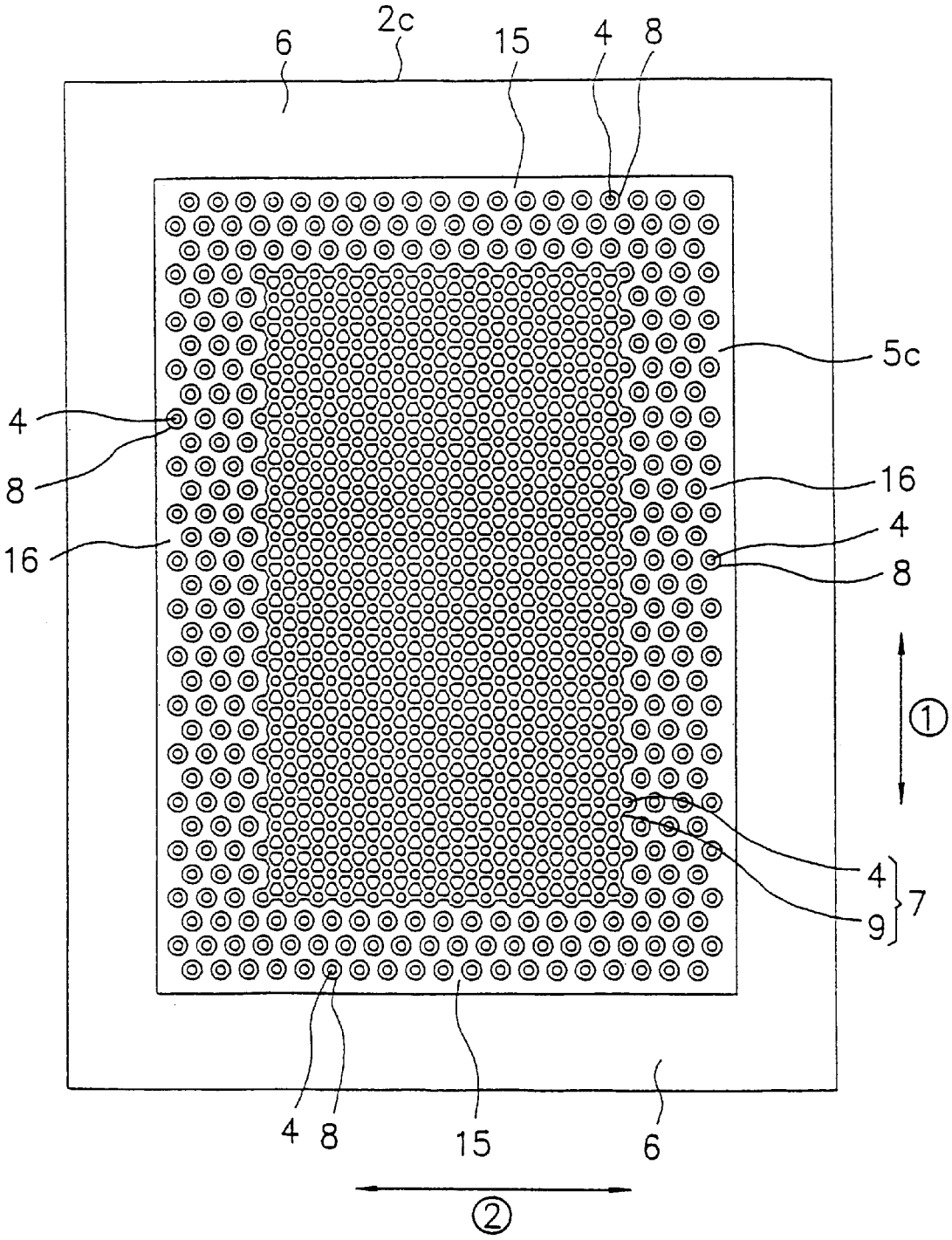
FIG. 6 is a plan view of a circumferential wall of a fourth embodiment.

A fourth embodiment will be explained referring to FIG. 6. As a stencil printing machine, basic constitution of this embodiment is approximately identical to that of the first embodiment. A pattern of a recessed portion in an opening portion 5*c* of the printing drum is different from the embodiment explained before, and is that combining the head and tail area 15 explained by FIG. 4 and the medium area 16 explained by FIG. 5. Namely, in the present embodiment, the medium area 16 is formed in both the edge portions of the opening portion 5*c* in the axial direction (2) of the printing drum 1. Further, the head and tail areas 15 are formed in the upper end (the head) and the lower end (the tail) in the rotational direction (1) of the printing drum. The each recessed portion formed in the head and tail areas 15 and the medium area 16 includes circular recesses respectively communicating through holes 4. The recesses 8 are independent from each other. They are not connected with each other. According to the present embodiment, there are obtained effects combining those of the embodiment shown in FIG. 4 and the embodiment shown in FIG. 5.

Figure 7:
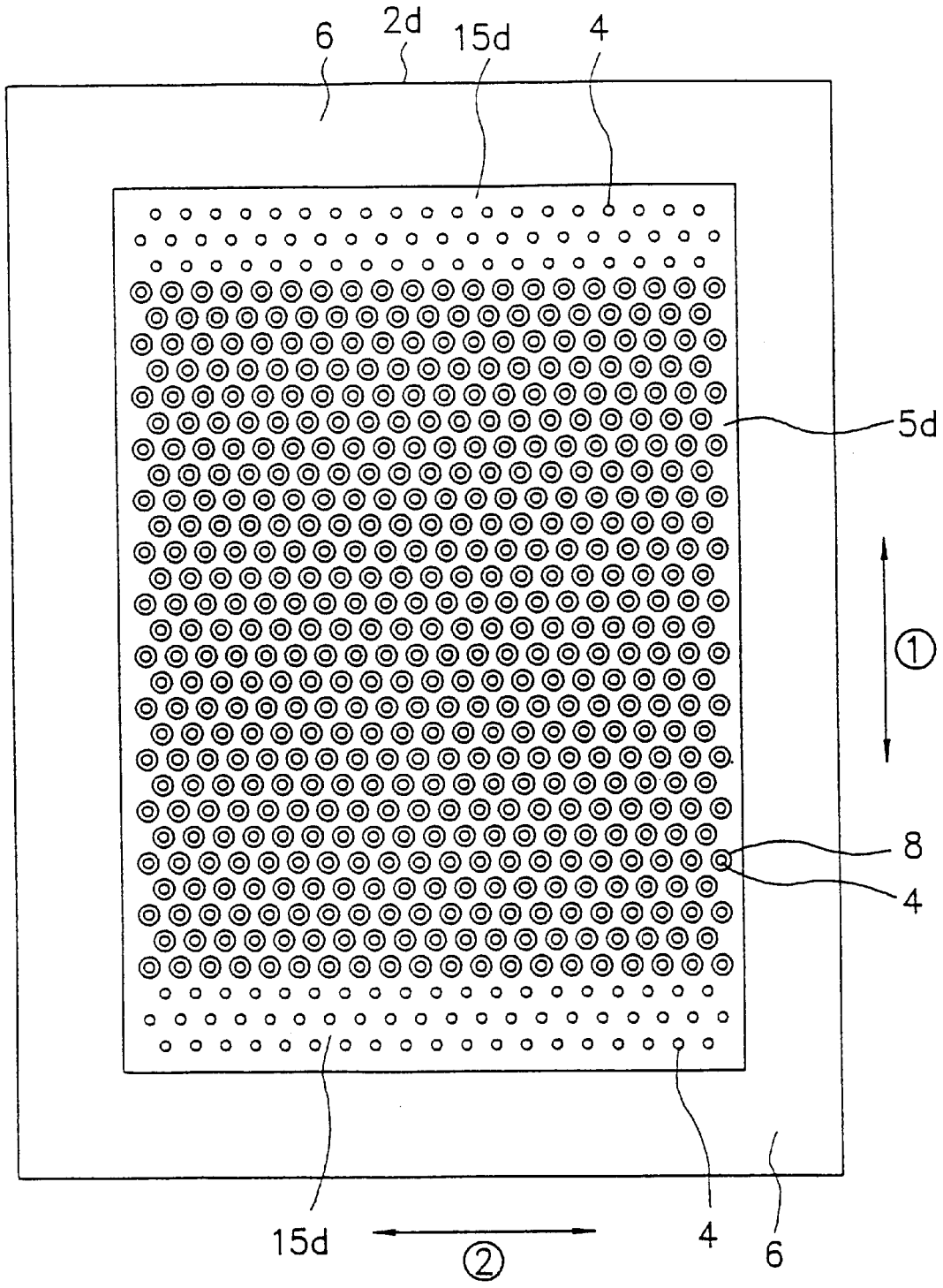
FIG. 7 is a plan view of a circumferential wall of a fifth embodiment.

A fifth embodiment will be explained referring to FIG. 7. As a stencil printing machine, basic constitution of this embodiment is approximately identical to that of the first embodiment. A pattern of a recessed portion in an opening portion 5*d* of the printing drum is different from the embodiment explained before. In the present embodiment, a pattern of the upper end (the head) and the lower end (the tail) in the rotational direction (1) of the printing drum, which direction is the circumferential direction or printing direction on printing sheet, is arranged to be different from that of another portion. No recessed portion is formed in this head and tail areas 15*d* of the opening portion 5*d*. The recesses 8 are formed in another area of the opening portion 5*d*. The recessed portion includes circular recesses respectively communicating through holes 4. The circular recesses 8 are independent from each other. They are not connected with each other. According to the present embodiment, there are obtained effects and operation approximately identical to those of the second embodiment. Rigidity of the opening portion 5*d* is higher than that of the second embodiment.

A sixth embodiment will be explained referring to FIG. 8. As a stencil printing machine, basic constitution of this embodiment is approximately identical to that of the first embodiment. A pattern of a recessed portion in an opening portion 5*e* of the printing drum is different from the embodiment explained before. In the present embodiment, recesses 17 are formed in both edge portions (a medium area 16*e*) of an opening portion 5*e* adjacent to the non-opening portion 6 in the axial direction (2). The recess 17 is rectangular. The recess 17 is independent from the through hole 4. Namely, the recess 17 and the through hole 4 are not interconnected with each other. That is, the recess 17 is formed between the through hole 4 and the same adjacent to each other in the circumferential direction (1).

According to the present embodiment, areas of circumferential wall 2*e* are, in order of decreasing rigidity, the non-opening portion 6, the center of the opening portion 5*e*, and the medium area 16*e*. Namely, a boundary area between the non-opening portion 6 and the opening portion 5*e* is most deformable. Hence, both the edge portions of the opening portion 5*e* can deform without excessive force, and printing pressure can be uniformly applied to the entire of the opening portion 5*e*. Therefore, quantity of ink transferred to a printing sheet is uniformed and a printed image without faintness can be obtained. Further, repetitive deformation is not likely to destroy both the edge portions of the opening portion 5*e*.

A seventh embodiment will be explained referring to FIG. 9. As a stencil printing machine, basic constitution of this embodiment is approximately identical to that of the first embodiment. A pattern of a recessed portion in an opening portion 5*f* of the printing drum is different from the embodiment explained before. In the present embodiment, the recesses 17 are formed in the entire of an opening portion 5*f*. The recess 17 is rectangular. The recess 17 of this embodiment is independent from the through hole 4. Namely, the recess 17 and the through hole 4 are not interconnected with each other. That is, the recess 17 is formed between the through hole 4 and the same adjacent to each other in the circumferential direction (1).

According to the present embodiment, both edge portions of the opening portion 5*f* adjacent to the non-opening portion 6 in the axial direction (2) of the printing drum have rigidity of extremely low value as compared to that of the non-opening portion 6. Hence, both the edge portions of the opening portion 5*f* easily deform. Therefore, printing pressure can be uniformly applied to the entire of the opening portion 5*f*. Consequently, quantity of ink transferred to a printing sheet is uniformed and a printed image without faintness can be obtained.

An eighth embodiment will be explained referring to FIG. 10. As a stencil printing machine, basic constitution of this embodiment is approximately identical to that of the first embodiment. A pattern of a recessed portion in an opening portion 5*g* of the printing drum is different from the embodiment explained before. In the present embodiment, recesses 18 are formed in both edge portion (a medium area 16*g*) of the opening portion 5 adjacent to the non-opening portion 6 in the axial direction (2) of the printing drum. The recess 18 is a rectangular groove. The recesses 18 of this embodiment are arranged along the circumferential direction (1) while connecting the through holes 4. That is, the recess 18 interconnects the through hole 4 and the same adjacent to each other in the circumferential direction (1).

Figure 8:
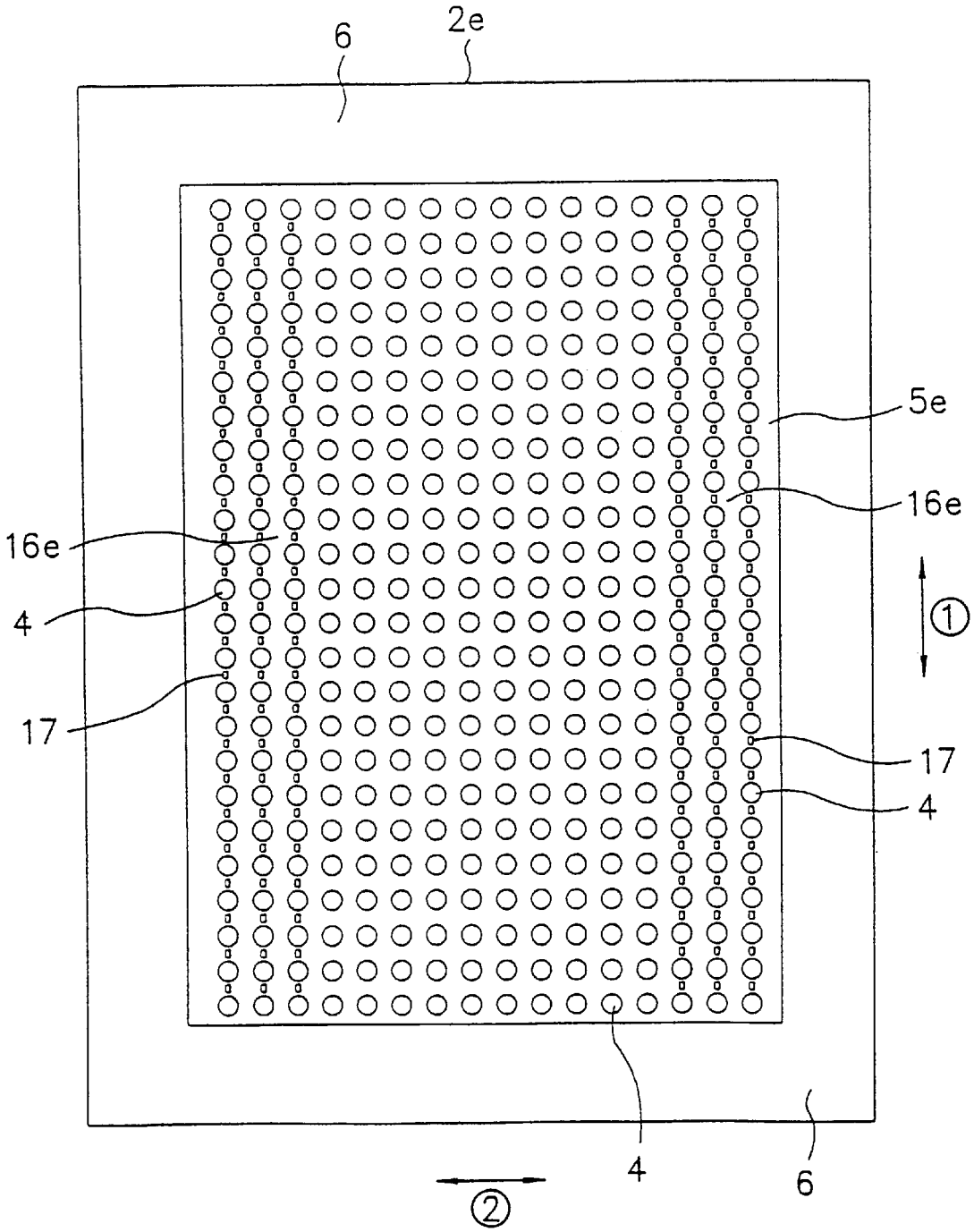
FIG. 8 is a plan view of a circumferential wall of a sixth embodiment.

According to the present embodiment, there are obtained effects approximately identical to those of the sixth embodiment shown in FIG. 8; however, both the edge portions of the opening portion 5*g* further easily deform since rigidity thereof is lower than that of the sixth embodiment.

A ninth embodiment will be explained referring to FIG. 11. As a stencil printing machine, basic constitution of this embodiment is approximately identical to that of the first embodiment. A pattern of a recessed portion in an opening portion 5*h* of the printing drum is different from the embodiment explained before. In the present embodiment, the recesses 18 are formed in the entire of the opening portion 5*h*. The recess 18 is a rectangular groove. The recesses 18 of this embodiment interconnect the through holes 4 arranged along the circumferential direction (1).

Figure 9:
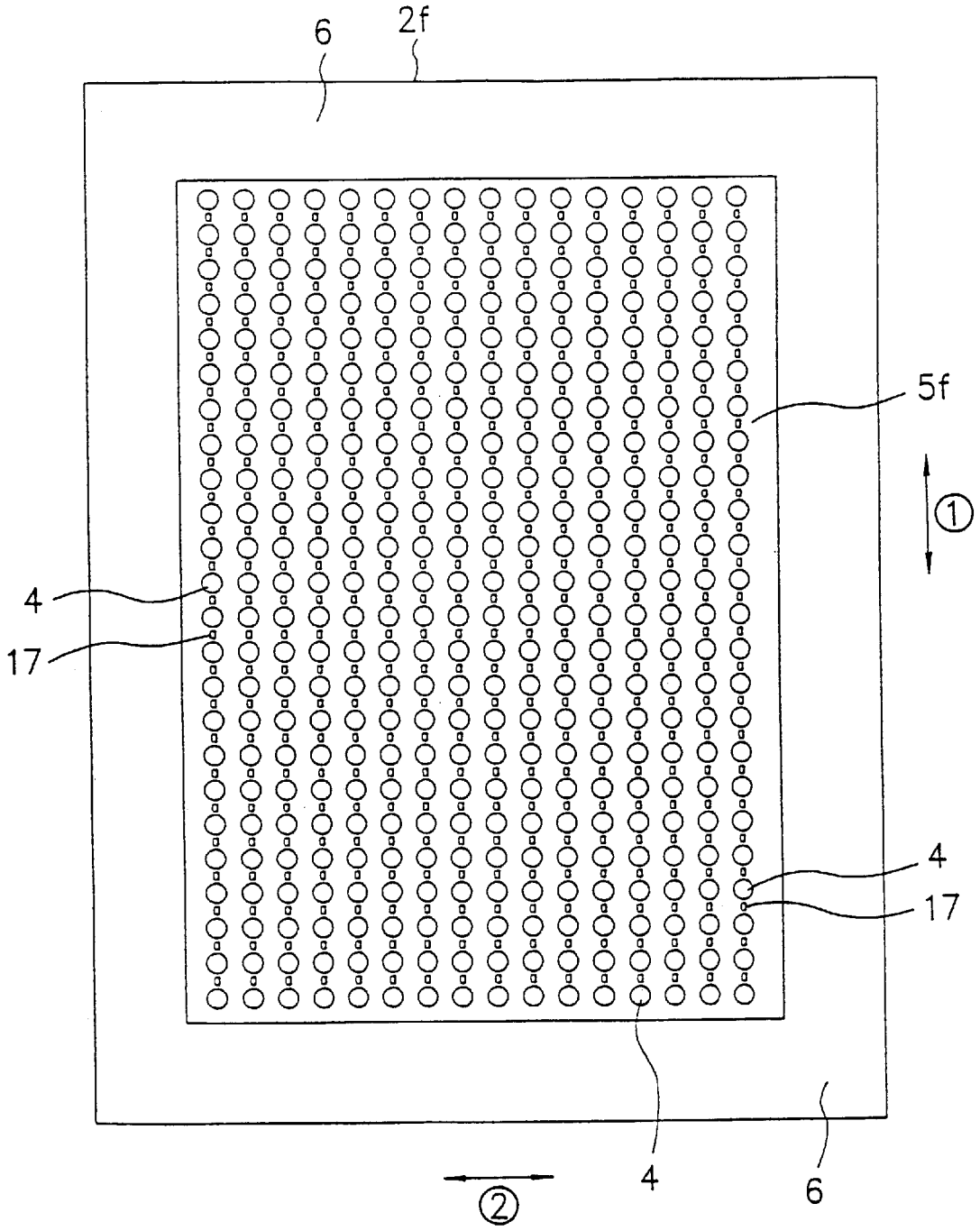
FIG. 9 is a plan view of a circumferential wall of a seventh embodiment.

According to the present embodiment, there are obtained effects approximately identical to those of the seventh embodiment shown in FIG. 9; however, the opening portion 5*h* further easily deforms since rigidity thereof is lower than that of the seventh embodiment.

Figure 12:
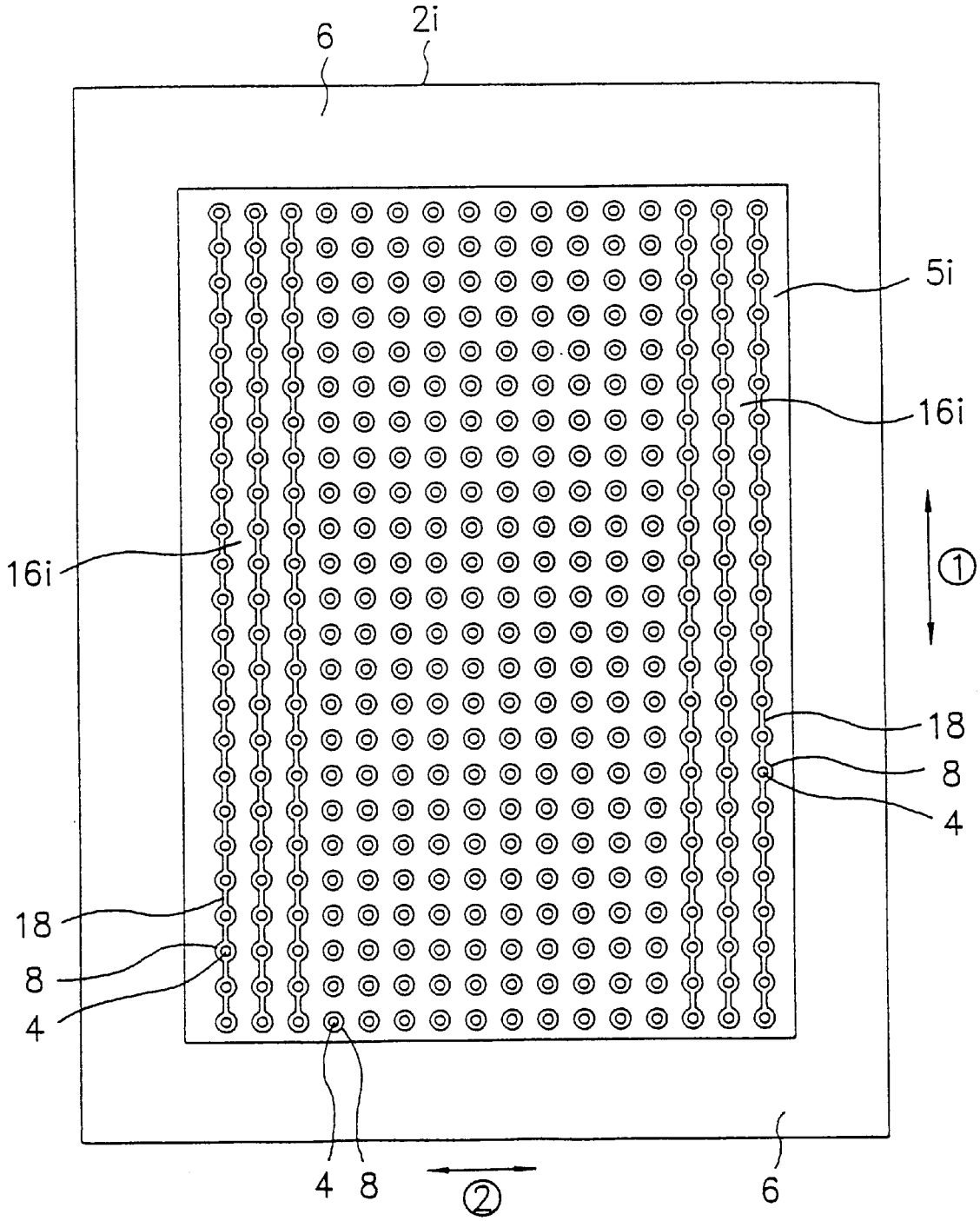
FIG. 12 is a plan view of a circumferential wall of a tenth embodiment.

A tenth embodiment will be explained referring to FIG. 12. As a stencil printing machine, basic constitution of this embodiment is approximately identical to that of the first embodiment. A pattern of a recessed portion in an opening portion 5*i* of the printing drum is different from the embodiment explained before. In the present embodiment, the recess 8 is formed to surround each of all the through holes 4 in the opening portion 5*i*. Further, the recess 18 in the form of rectangular groove is formed in both edge portions (a medium area 16*i*) of the opening portion 5*i* adjacent to the non-opening portion 6 in the axial direction (2) of the printing drum. The recess 18 of the rectangular groove form interconnects the circular recesses 8 arranged along the circumferential direction (1). That is, the circular recess 8 and the recess 18 of the rectangular groove interconnect the through hole 4 and the same arranged along the circumferential direction.

Figure 10:
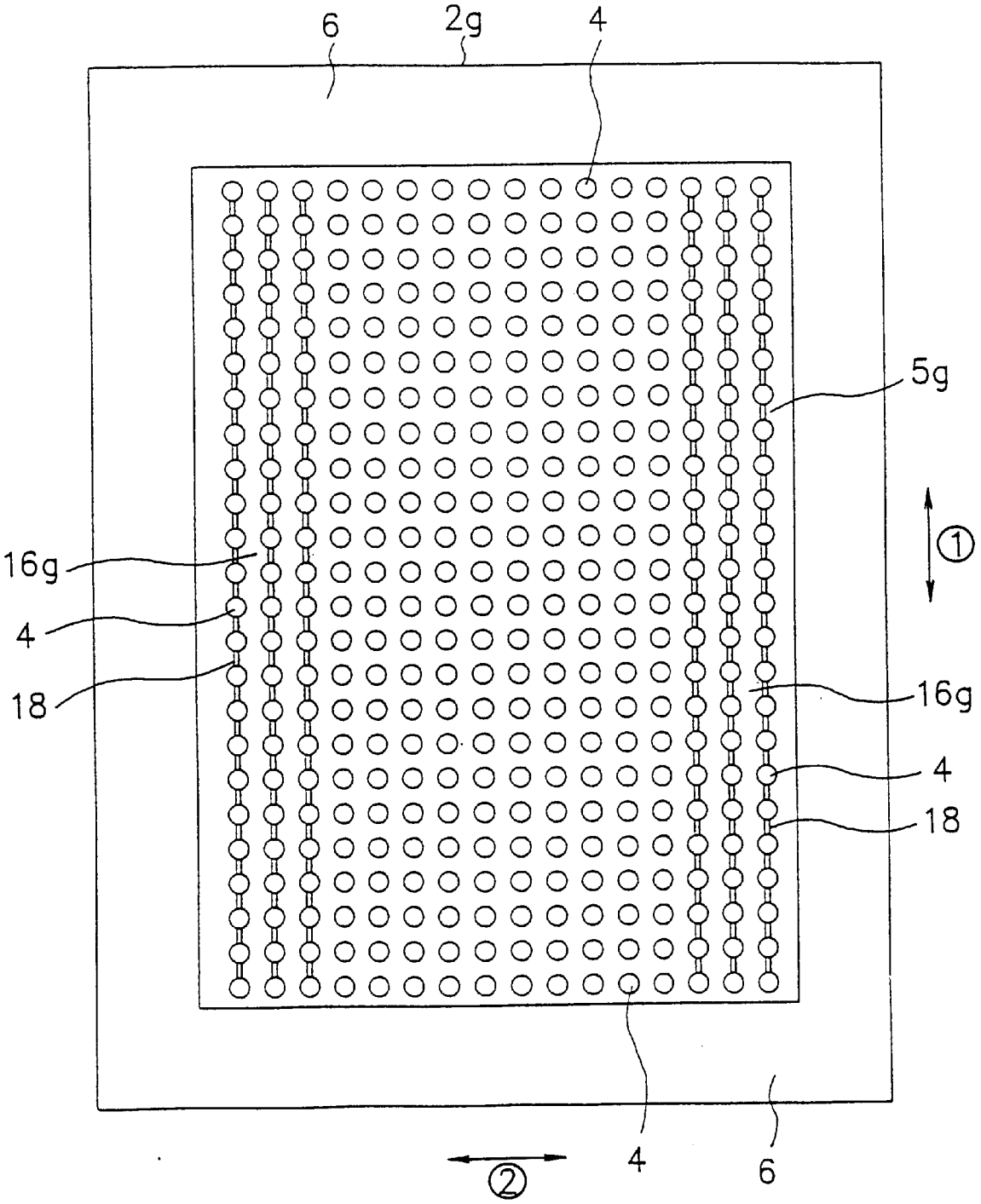
FIG. 10 is a plan view of a circumferential wall of an eighth embodiment.

According to the present embodiment, there are obtained effects approximately identical to those of the sixth or eighth embodiment respectively shown in FIGS. 8 and 10; however, the opening portion 5*i* and both the edge portions 16*i* thereof further easily deform since their rigidity is lower than those of the previous embodiments.

Figure 13:
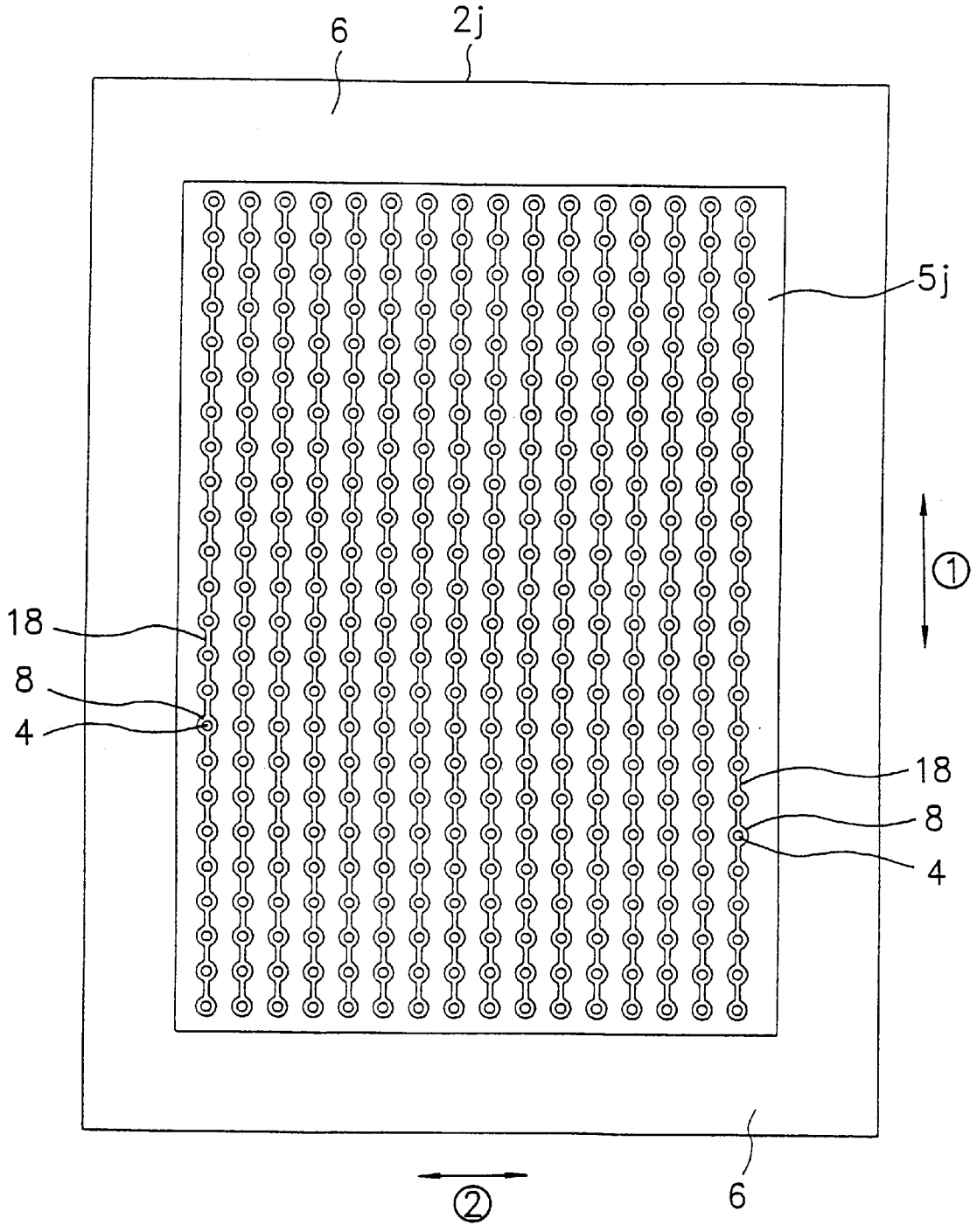
FIG. 13 is a plan view of a circumferential wall of a eleventh embodiment.

An eleventh embodiment will be explained referring to FIG. 13. As a stencil printing machine, basic constitution of this embodiment is approximately identical to that of the first embodiment. A pattern of a recessed portion in an opening portion 5*j* of the printing drum is different from the embodiment explained before. In the present embodiment, the recess 8 is formed to surround each of all the through holes 4 in the opening portion 5*j*. Further, all the circular recesses 8 are interconnected by the recesses 18 arranged along the circumferential direction (1). Namely, the circular recess 8 and the recess 18 of the rectangular groove form interconnect the through hole 4 and the same arranged along the circumferential direction (1).

Figure 11:
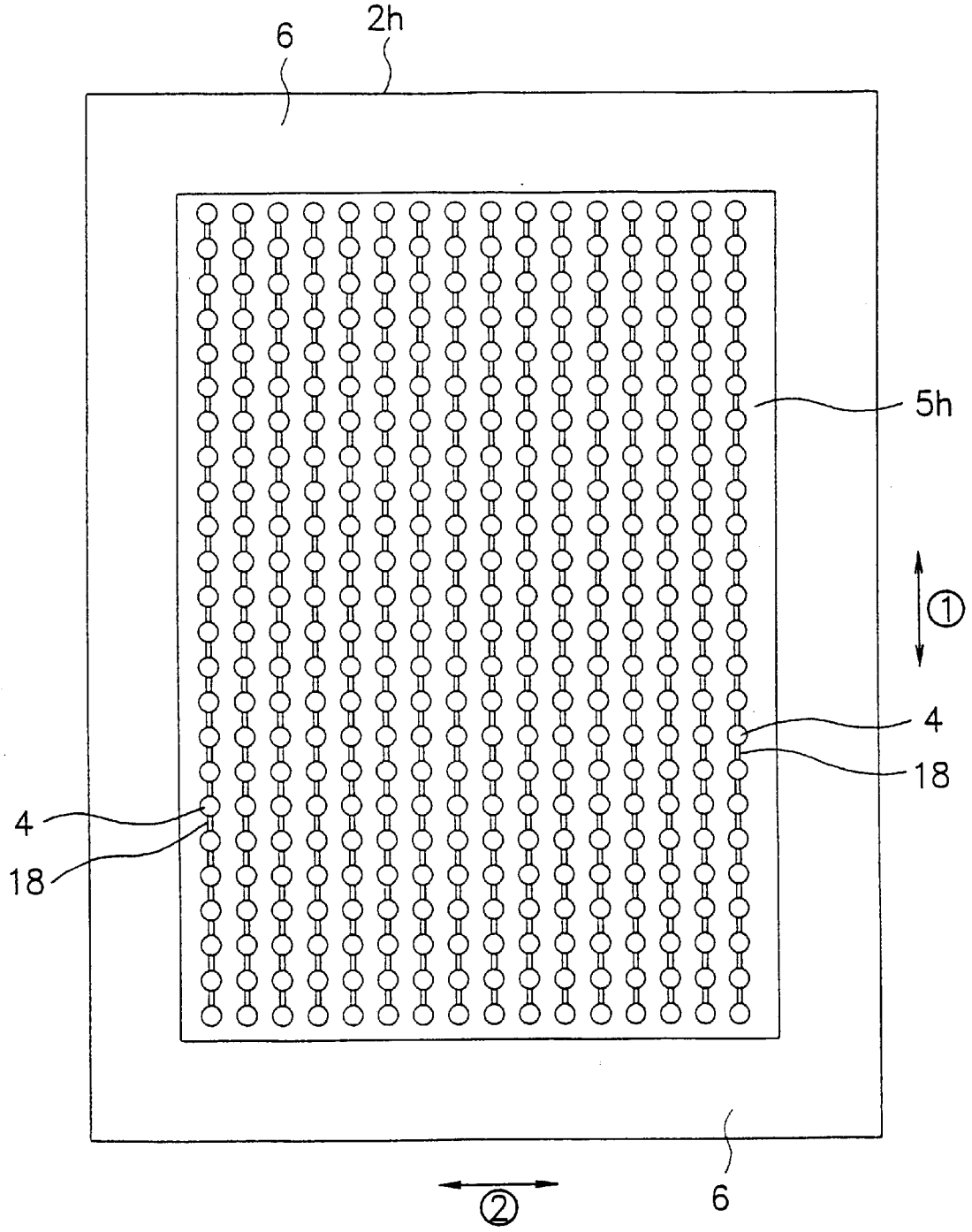
FIG. 11 is a plan view of a circumferential wall of a ninth embodiment.

According to the present embodiment, there are obtained effects approximately identical to those of the seventh or ninth embodiments respectively shown in FIGS. 9 and 11; however, the opening portion 5*j* and both the edge portions thereof further easily deform since their rigidity is lower than those of the previous embodiments.

Figure 14:
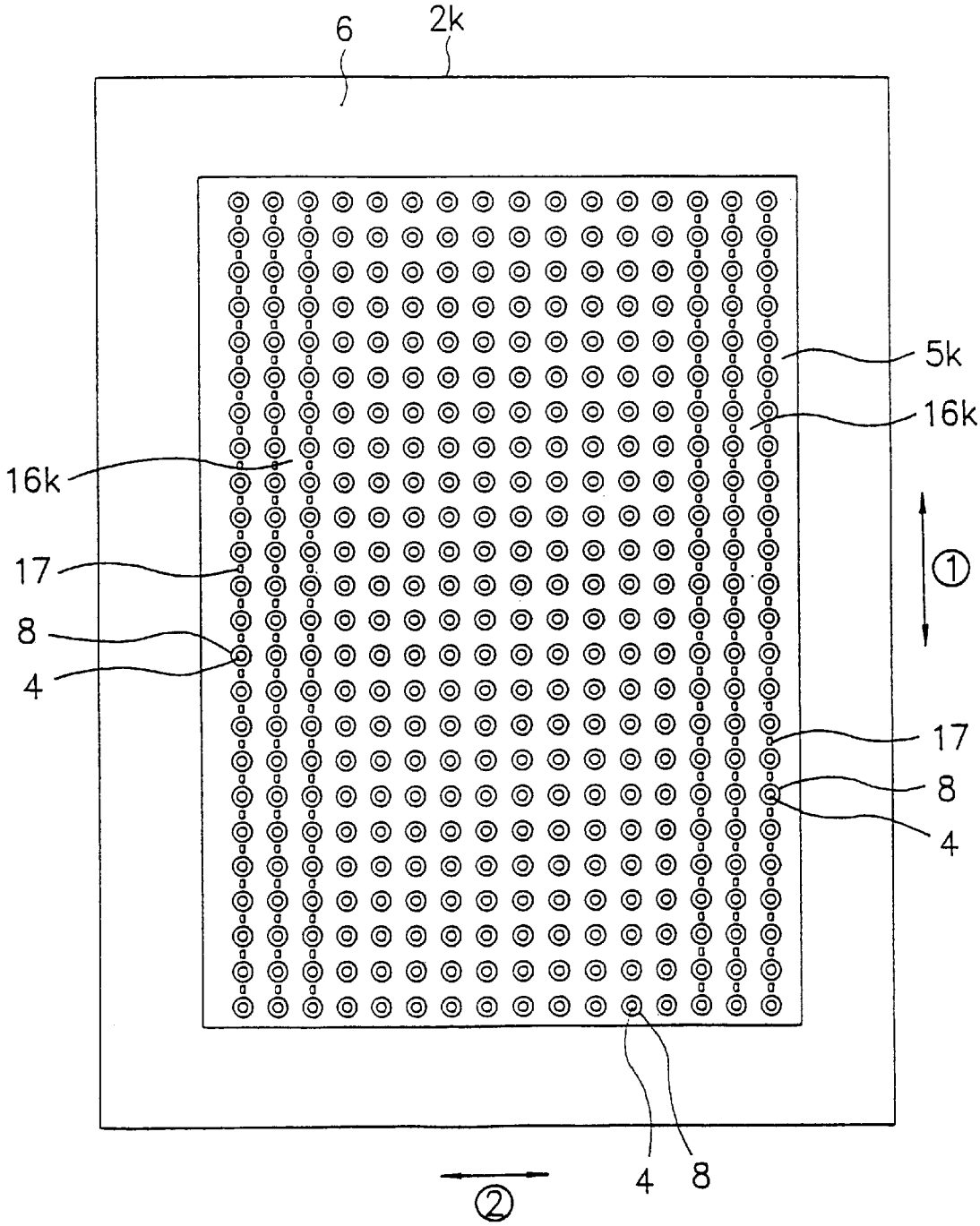
FIG. 14 is a plan view of a circumferential wall of a twelfth embodiment.

A twelfth embodiment will be explained referring to FIG. 14. As a stencil printing machine, basic constitution of this embodiment is approximately identical to that of the first embodiment. A pattern of a recessed portion in an opening portion 5*k* of the printing drum is different from the embodiment explained before. In the present embodiment, the circular recess 8 is formed to surround each of all the through holes 4 in the opening portion 5*k*. Further, the rectangular recesses 17 are formed in both edge portions (a medium area 16*k*) of the opening portion 5*k* adjacent to the non-opening portion 6 in the axial direction (2) of the printing drum. The rectangular recess 17 is formed between the through hole 4 and the same arranged along the circumferential direction (1) of the printing drum, and independent from the through hole 4 and the circular recess 8. Namely, the through holes 4 are not interconnected with each other.

According to the present embodiment, there are obtained effects approximately identical to those of the sixth embodiment shown in FIG. 8; however, the opening portion 5*k* and both the edge portions 16*k* of the opening portion 5*k* further easily deform since their rigidity is lower than that of the previous embodiment.

Figure 15:
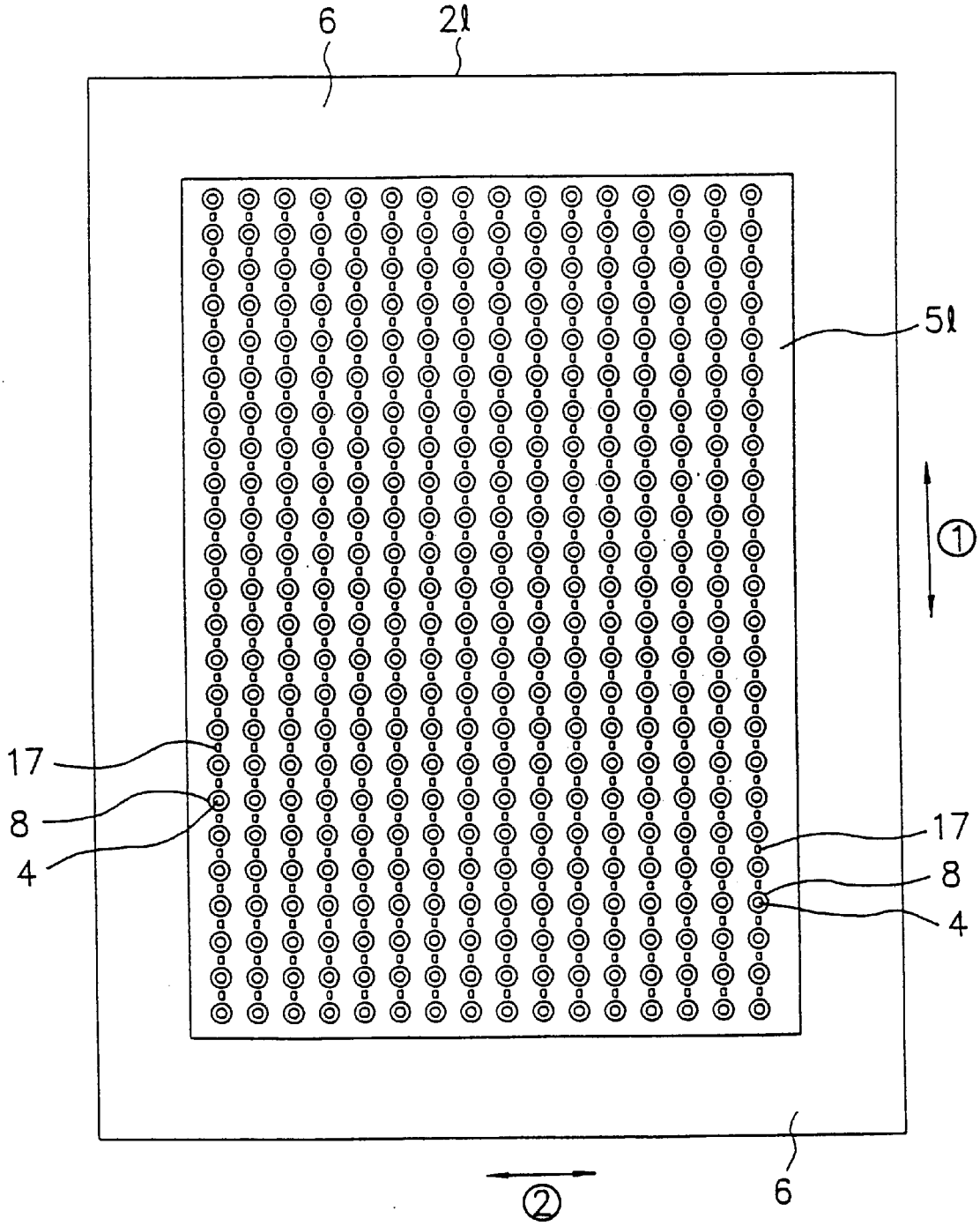
FIG. 15 is a plan view of a circumferential wall of a thirteenth embodiment.
Figure 16:
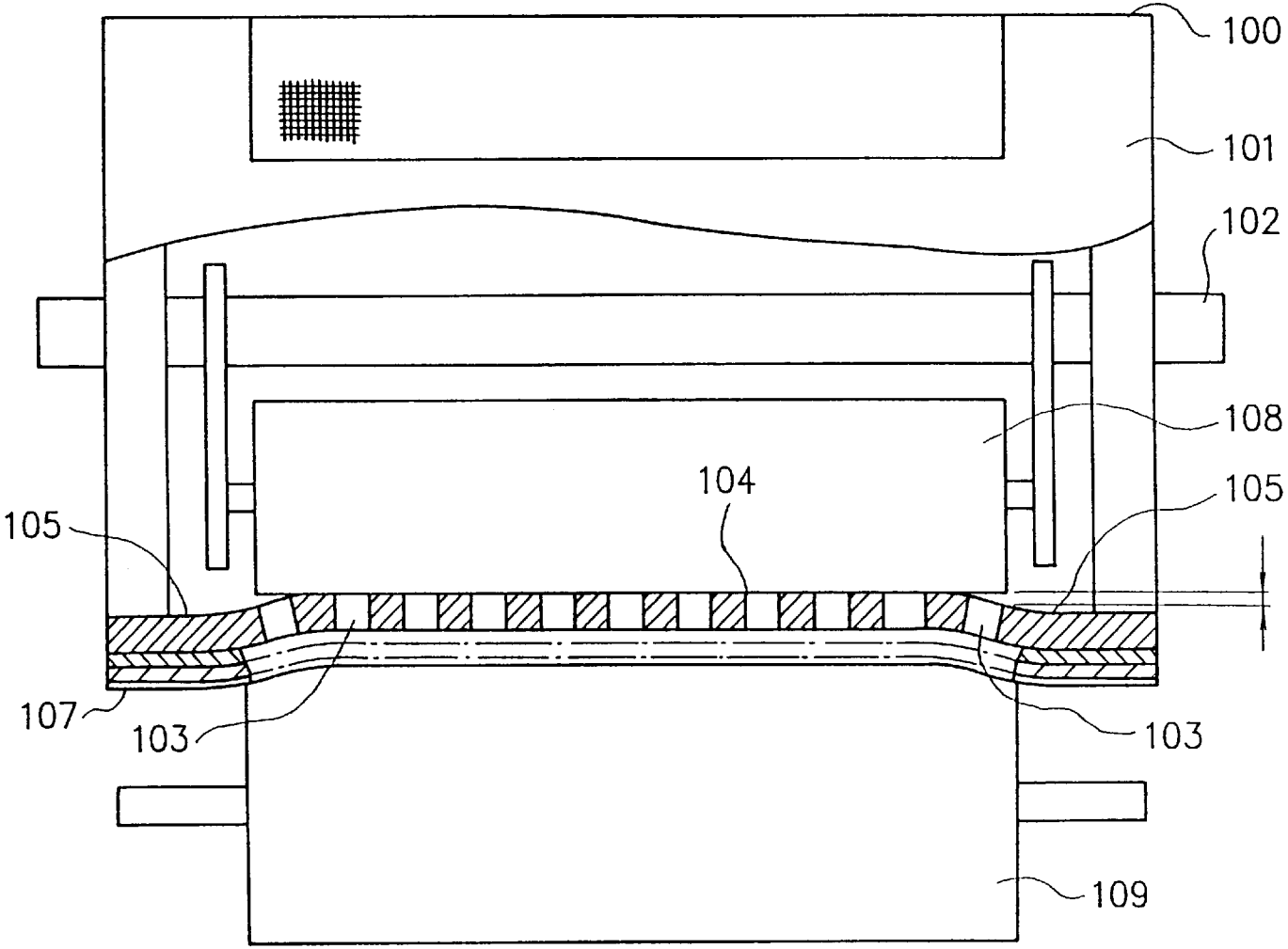
Fig. 16 Prior Art
FIG. 16 is a sectional view of a conventional stencil printing machine.
Figure 17:
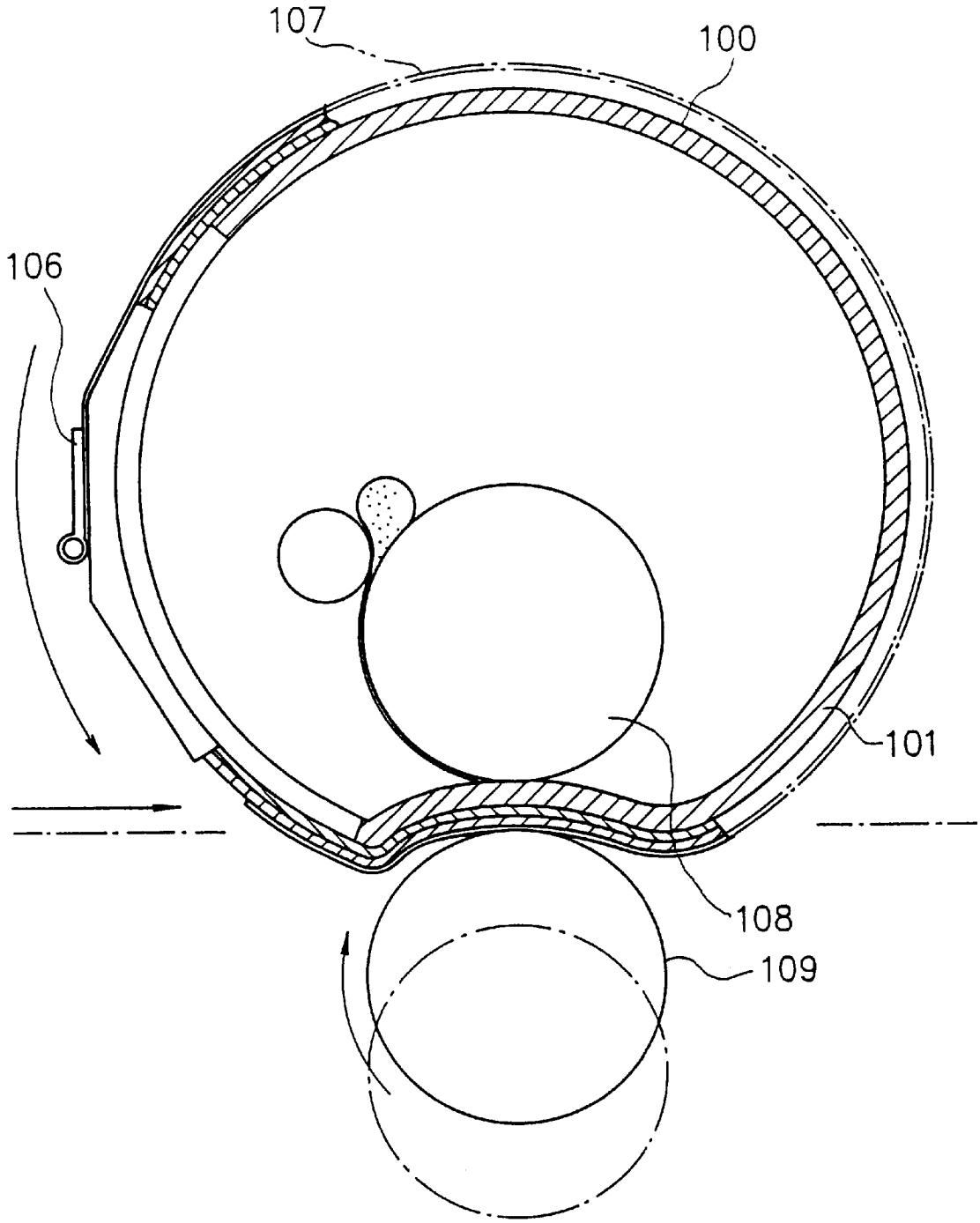
Fig. 17 Prior Art
FIG. 17 is a sectional view taken along a plane perpendicular to FIG. 16.
Figure 18:
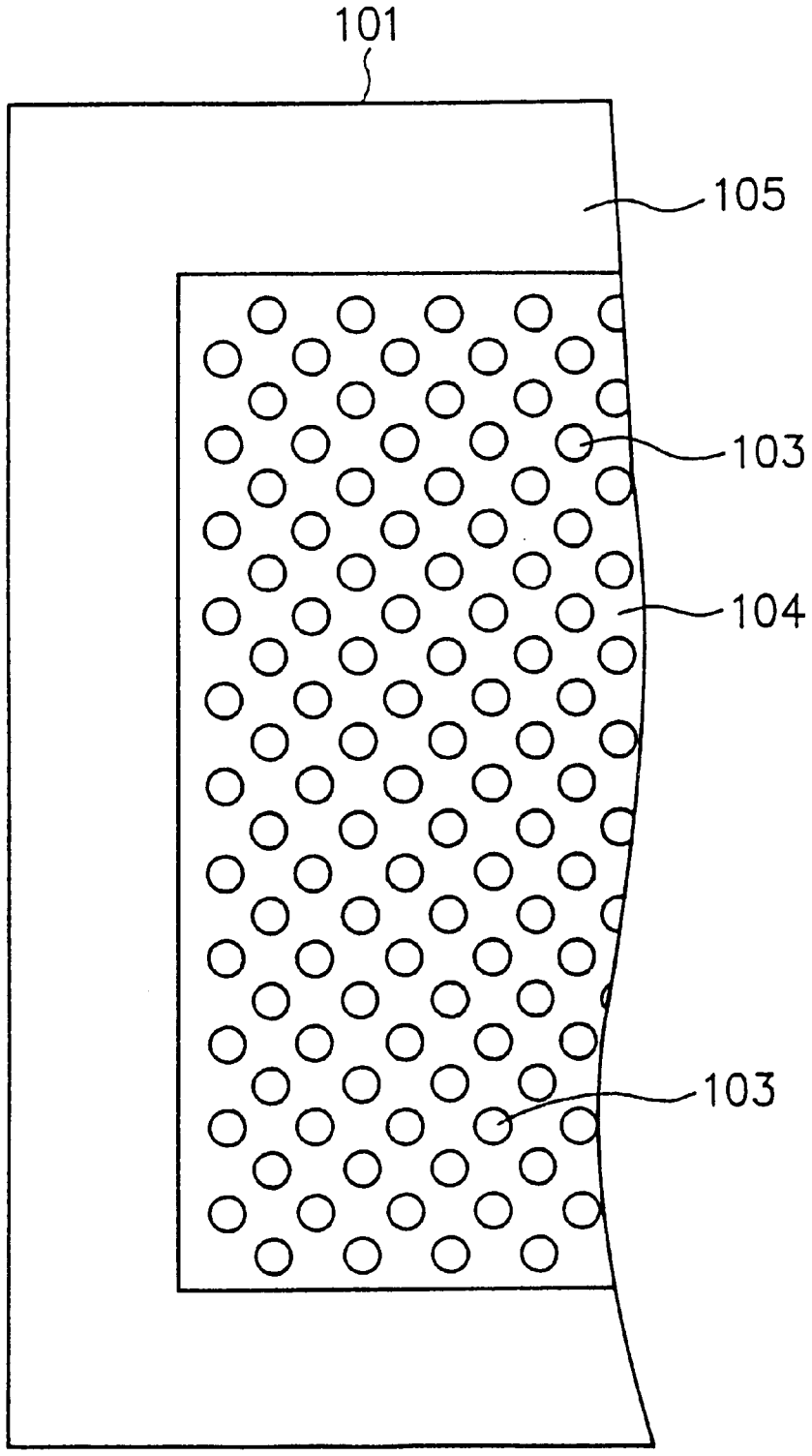
Fig. 18 Prior Art
FIG. 18 is a partial plan view of a circumferential wall of a prior art.

A thirteenth embodiment will be explained referring to FIG. 15. As a stencil printing machine, basic constitution of this embodiment is approximately identical to that of the first embodiment. A pattern of a recessed portion in an opening portion 5*l* of the printing drum is different from the embodiment explained before. In the present embodiment, the circular recess 8 is formed to surround each of all the through holes 4 in the opening portion 5*l*. Further, in the entire of the opening portion 5*l*, the rectangular recess 17 is formed between the through hole 4 and the same arranged along the circumferential direction (1) of the printing drum. The rectangular recess 17 is independent from the though hole 4 and the circular recess 8. Namely, the through holes 4 are not interconnected with each other.

According to the present embodiment, there are obtained effects approximately identical to those of the seventh embodiment shown in FIG. 9; however, the opening portion 5*l* and both the edge portions 16*k* of the opening portion 5*l* further easily deform since their rigidity is lower than that of the previous embodiment.

In the embodiments explained before, rigidity of a portion of the circumferential wall can be optionally determined by arranging the opening shape, the depth, and the inner form of the recessed portion to be formed there. The through hole and the recessed portion can be formed by etching.

In the stencil printing machine of the present invention, a printing drum having an opening portion and a non-opening portion is driven to rotate with a stencil sheet being wrapped thereon while ink is supplied to the inner circumferential surface thereof, and a printing sheet is pressed against the stencil sheet by a press roller, thereby conducting printing; further, a non-through recessed portion is formed in the opening portion adjacent to the non-opening portion in an axial direction of the circumferential wall. Consequently, rigidity acting in the axial direction in printing area of the printing drum decreases, thereby improving deformability of the drum according to the press roller in printing. Hence, an appropriate printing pressure can be applied to the entire of the opening portion, so that normal printing can be conducted on the entire of the printing area.

What is claimed is:

1. A stencil printing machine comprising:

a printing drum including a cylindrical circumferential wall adapted to receive a perforated stencil sheet wrapped on an outer circumferential surface thereof and driven to rotate around a central axis thereof, said circumferential wall having an opening portion with many through holes formed therein, non-opening portions formed at opposite axial ends along the central axis of the printing drum to sandwich said opening portion therebetween, and at least one recessed portion formed in at least a part of said opening portion adjacent to said non-opening portions in an axial direction of said circumferential wall to thereby reduce rigidity of the opening portion adjacent to the non-opening portions;

an ink supplying roller situated in said printing drum for supplying ink to an inner circumferential surface of said cylindrical circumferential wall of said printing drum; and a press roller situated adjacent to said printing drum and being urged against said outer circumferential surface of said cylindrical circumferential wall of said printing drum.

2. A stencil printing machine as claimed in claim 1, wherein said at least one recessed portion communicates with said through holes.

3. A stencil printing machine as claimed in claim 2, wherein said at least one recessed portion is formed continuously to surround said through holes.

4. A stencil printing machine as claimed in claim 2, wherein said at least one recessed portion interconnects said through holes adjacent to each other.

5. A stencil printing machine as claimed in claim 2, wherein said at least one recessed portion includes a plurality of recesses, each being formed between said through holes adjacent to each other to extend in a circumferential direction of said printing drum.

6. A stencil printing machine as claimed in claim 1, wherein said at least one recessed portion includes a plurality of recesses formed independently from said through holes.

7. A stencil printing machine as claimed in claim 6, wherein each of said recesses is formed between said through holes adjacent to each other in said circumferential wall.

8. A stencil printing machine as claimed in claim 6, wherein each of said recesses is formed between said through holes adjacent to each other to extend in a circumferential direction of said printing drum.

9. A stencil printing machine as claimed in claim 1, wherein said at least one recessed portion is formed on said outer circumferential surface of said circumferential wall.

10. A stencil printing machine as claimed in claim 1, wherein the outer circumferential surface except for the through holes and the at least one recessed portion at the opening portion forms a continuous outer surface of the cylindrical circumferential wall.

11. A stencil printing machine as claimed in claim 1, wherein rigidity of said opening portion only including said through holes is between rigidity of said non-opening portion and rigidity of said opening portion including said at least one recessed portion.

12. A stencil printing machine as claimed in claim 1, wherein said at least one recessed portion includes two recessed portions situated adjacent to the non-opening portions, said opening portion between the two recessed portions having no recessed portions or recessed portions different from the two recessed portions.

13. A stencil printing drum comprising:

a cylindrical circumferential wall adapted to receive a perforated stencil sheet wrapped on an outer circumferential surface thereof and driven to rotate around a central axis thereof, said circumferential wall having an opening portion with many through holes formed therein, non-opening portions formed at opposite axial ends along the central axis of the printing drum to sandwich said opening portion therebetween, and at least one recessed portion formed in said opening portion adjacent to said non-opening portions in an axial direction of said circumferential wall, wherein rigidity of said opening portion only including said through holes is between rigidity of said non-opening portion and rigidity of said opening portion including said at least one recessed portion to thereby reduce rigidity of the opening portion adjacent to the non-opening portions.

14. A stencil printing drum as claimed in claim 13, wherein the outer circumferential surface except for the through holes and the at least one recessed portion at the opening portion, and the outer circumferential surface at the non-opening portions form a continuous outer surface of the cylindrical circumferential wall.

15. A stencil printing machine as claimed in claim 13, wherein said at least one recessed portion includes two recessed portions situated adjacent to the non-opening portions, said opening portion between the two recessed portions having no recessed portions or recessed portions different from the two recessed portions.

* * * * *